US005326455A

United States Patent [19]

Kubo et al.

[11] Patent Number: 5,326,455

[45] Date of Patent: Jul. 5, 1994

[54] METHOD OF PRODUCING ELECTROLYTIC COPPER FOIL AND APPARATUS FOR PRODUCING SAME

[75] Inventors: Toyoshige Kubo; Katsuhiko Fujishima; Narito Yamamoto, all of Hitachi, Japan

[73] Assignee: Nikko Gould Foil Co., Ltd., Tokyo, Japan

[21] Appl. No.: 965,115

[22] Filed: Oct. 22, 1992

Related U.S. Application Data

[63] Continuation-in-part of Ser. No. 794,272, Nov. 19, 1991, abandoned.

[30] Foreign Application Priority Data

Dec. 19, 1990 [JP] Japan ..... 2-411764
Dec. 19, 1990 [JP] Japan ..... 2-411765
Dec. 19, 1990 [JP] Japan ..... 2-411766

[51] Int. Cl.[5] ..... C25D 1/04

[52] U.S. Cl. ..... 205/77; 204/211; 205/84; 205/96

[58] Field of Search ..... 205/96, 97, 77, 84; 204/211

[56] References Cited

U.S. PATENT DOCUMENTS 3,799,847 3/1974 Vladimirovna et al. ..... 205/77
4,053,370 10/1977 Yamashita et al. ..... 205/77 X
4,490,218 12/1984 Kadija et al. ..... 205/77

FOREIGN PATENT DOCUMENTS 2271306 of 1975 France .
49-18902 of 1974 Japan .
50-2378 of 1975 Japan .
63-259098 10/1988 Japan ..... C25D 7/60

OTHER PUBLICATIONS

F. A. Lowenheim, *Electroplating*, Ch. 20 "Electroforming", McGraw-Hill Book Co., New York, 1978, pp. 426–441.

ANSI/IPC-CF-150E "Copper Foil of Printing Wiring Applications" The Inst. for Interconnecting and Packaging Electronic Circuits (May 1981).

*Primary Examiner*—John Niebling
*Assistant Examiner*—William T. Leader
*Attorney, Agent, or Firm*—Seidel, Gonda, Lavorgna & Monaco

[57] ABSTRACT

In a method of producing an electrolytic copper foil by passing an electrolyte between a rotating cathode drum and anode located opposite to the cathode drum, the thickness of the resulting copper foil is made uniform throughout. The anode has a structure including a main portion and an end portion, the end portion being divided widthwise into n foil thickness-uniformizing sub-anodes. Electricity is supplied to the main anode and the sub-anodes at a preset current density D ($A/dm^2$) to attain a target foil thickness T ($g/m^2$). Variations of thickness in the direction of the width of the resulting copper foil are measured as the thicknesses Tm ($g/m^2$) where $m=1-n$ in the direction of the width of the copper foil corresponding to the n sub-anodes, and the quantities of electricity being supplied to the n sub-anodes are individually controlled at current densities Dm ($A/dm^2$) where $m=1-n$ so that Tm values are made equal to the target foil thickness T ($g/m^2$). Alternatively, a pattern of thickness deviations of a copper foil produced per revolution of the cathode drum is divided into m sections where $m=1-n$ widthwise and k sections lengthwise, the foil thicknesses $Tm-k$ ($g/m^2$) where $m=1-n$ of the $m \times k$ sections corresponding to the angle of rotation from a reference point of the cathode drum as determined by an encoder are measured, and the quantities of electricity supplied to the n sub-anodes at current densities $Dm-k$ ($A/dm^2$) where $m=1-n$ are controlled individually correspondingly to the angle of rotation from the reference point of the cathode drum so that $Tm-k$ becomes equal to the target foil thickness T.

25 Claims, 5 Drawing Sheets

METHOD OF PRODUCING ELECTROLYTIC COPPER FOIL AND APPARATUS FOR PRODUCING SAME

CROSS REFERENCE INFORMATION

This is a continuation-in-part application of copending patent application Ser. No. 794,272 filed on Nov. 19, 1991, now abandoned.

FIELD OF THE INVENTION

This invention relates to a method of producing an electrolytic copper foil. More particularly, this invention relates to a method of producing an electrolytic copper foil characterized by the provision of a plurality of foil thickness-uniformizing sub-anodes divided widthwise for uniformizing the thickness of the electrolytic copper foil being made and by the individual control of the quantities of electricity being supplied to the sub-anodes. The invention enables to produce a high-quality electrolytic copper foil having by far the less variation in thickness than heretofore attained and suited, e.g., for use in printed circuits.

BACKGROUND OF THE INVENTION

Electrolytic copper foil is produced by passing a stream of electrolyte between an anode of insoluble metal and a rotatable metallic cathode drum mirror-polished on the surface and supplying a potential between the anode and the cathode drum, thereby causing electrodeposition of copper on the cathode drum surface, and, when the electrodeposit has attained a predetermined thickness, peeling the same from the cathode drum. The copper foil thus obtained, called an untreated foil, is thereafter variously surface-treated to be final products.

FIG. 1 illustrates the relative position of a cathode drum and an anode conventionally used for the manufacture of copper foil. In an electrolytic cell (not shown) containing an electrolyte, the cathode drum 1 is installed to be rotatable (clockwise in this case) as partly submerged in the electrolyte. The anode is disposed as divided into, e.g., two anode sheets 3 to cover generally the submerged lower half of the cathode drum 1 in spaced relation with a given clearance from the drum surface. Inside the electrolytic cell, the electrolyte is supplied at 6 o'clock position (of the hour hand, the same applying hereinafter) between the two anode sheets 3. It flows upward along the space between the cathode drum and the anode and overflows the upper edges of the anode for circulation in the cell. A rectifier 5 maintains a given current between the cathode drum and the anode.

As the cathode drum 1 rotates, the electrodeposit of copper from the electrolyte becomes thicker, until it attains a desired thickness around 9 o'clock position, and the resulting untreated foil of the desired thickness is peeled off by suitable peeler means from the drum and is wound up.

In the apparatus for manufacturing electrolytic copper foil, when the operation has continued for a given time period, the anode, among others, is locally worn with use. Consequently, the space between the cathode drum and the anode sheets becomes uneven and the resulting untreated foil becomes uneven in thickness, depending on the characteristics of the apparatus used, till it becomes unmarketable. That is, by the lack of uniformity of the distance between the anode and the cathode drum and the variation of the flow velocity of the electrolyte being supplied etc., the resulting untreated foil undergoes variation in thickness in the direction of the width.

The resulting foil develops variation in thickness in the direction of the length too, in approximately the same pattern per revolution of the cathode drum, due largely to the eccentricity of the rotating cathode drum with periodic variation of the spacing between the anode and the cathode drum.

FIG. 2 is a schematic representation of an illustrative thickness distribution in a half-width section of a copper foil produced. The remaining half-width section not shown has a generally similar variation in thickness widthwise. Thus, the electrolytic copper foil conventionally produced has inevitable variations in thickness in both width and length directions, to varying degrees depending on the manufacturing conditions encountered.

In fact, much difficulties are involved in uniformizing the thickness of an electrolytic copper foil. For example, ANSI/IPC-CF-150E (May, 1981) "Copper Foil of Printed Wiring Applications", which is a standard developed by the Copper Foil Subcommittee of the Raw Materials Committee of the Institute for Interconnecting and Packaging Electronic Circuits, provides: "The area weight or thickness of the copper foil shall be within ±10% of the values shown in Table 1 for Type E copper (Electrodeposited copper foil) and ±5% for Type W copper (Wrought copper foil)." The provision thus allows for as much as 10% variation in thickness for electrodeposited copper foils in the thickness range from 18 to 498 μm. This shows how difficult it is to control the thickness of electrolytic copper foil so as to uniformize it.

Nevertheless, there has recently been strong demand for electrolytic copper foils of uniform thickness throughout. Copper foils are used chiefly for the fabrication of printed circuit boards, and the tendency toward finer circuits to be formed requires uniform etching of the copper foil and for the purpose a copper foil of uniform thickness is strongly necessitated. For the stabilization of its electric characteristics too, the copper foil must have far less variation in thickness than heretofore.

To make an electrolytic copper foil uniform in thickness throughout the direction of its width, the following steps have hitherto been taken:

(1) Anode milling: With an apparatus for the production of electrolytic copper foil, it has been common that anode after runs for a certain length of time is worn out of use, making the space between itself and the cathode drum uneven. As used herein, the expression "out of use" suggests an abnormal rise of the electrolytic voltage or serious unevenness in thickness of the copper foil produced. In order to avoid this, the anode after service for a given time period is cylindrically reformed on the surface by a special cutting tool.

(2) Partial anode cutting: After anode milling, variation of thickness in the direction of the width of the resulting copper foil is measured. According to the data thus obtained, the anode surface is locally cut off to properly correct the thickness of the copper foil.

Such correcting steps being taken until today restrict the variations of electrolytic copper foil thickness in the direction of its width to the order of about 5% of the target thickness. Little attention has been paid, on the other hand, to the variations of thickness in the direction of the length.

These correction working is a time-consuming, laborious work, necessitating long downtime at regular intervals. However, the precision is nevertheless unsatisfactory. These counter-measures cannot cope with the variations in thickness widthwise from uncertain causes for which the anode is not to blame. In addition, the effect of such a measure, if achieved, would be short-lived.

OBJECTS OF THE INVENTION

It is an object of the present invention to develop a novel method of producing an electrolytic copper foil whereby the variations of foil thickness in the direction of the width due to the wear of the anode and from indefinite causes can be reduced to by far the lower level than heretofore, without the need of interrupting the operation.

Another object of the invention is to develop such a novel method of producing an electrolytic copper foil which can reduce not only the variations of foil thickness in the direction of the width but also the variations in the direction of the length.

SUMMARY OF THE INVENTION

The inventors conceived the idea of dividing an anode into two parts for separate functions; one for forming the basic thickness of a foil and the other for uniformizing the thickness. For the purposes of the invention, the former is termed main anode and the latter is termed sub-anodes. The main anode is supplied with electricity at a uniform current density throughout the entire width. The sub-anodes are divided into a proper number of pieces in the direction of the width, and the current densities for the individual sub-anodes are controlled on the basis of the production results so as to make the thickness of the resulting foil uniform. As the result, it is concurrently possible to make the foil thickness uniform in the direction of the width and uniform in both directions of the width and length.

The present invention, in its first aspect, provides a method of producing an electrolytic copper foil by passing an electrolyte between a rotating cathode drum and at least one sheet of anode located opposite to the cathode drum, this electrolytically depositing copper on the cathode drum surface, and then peeling off the resulting copper foil from the drum, characterized by:

(a) constructing said anode so as to have a structure such that the end portion thereof on the copper foil-recovering side is divided widthwise into n pieces of foil thickness-uniformizing sub-anodes, and the remainder of the anode serves as a main anode;

(b) supplying electricity to the main anode and the foil thickness-uniformizing sub-anodes at a given current density D ($A/dm^2$) set to attain a target foil thickness T ($g/m^2$); and (c) measuring variations of thickness in the direction of the width of the resulting copper foil as the thicknesses Tm ($g/m^2$) (where $m=1\sim n$) in the direction of the width of the copper foil corresponding to the n pieces of foil thickness-uniformizing sub-anodes, and individually increasing or decreasing under control the quantities of electricity being supplied to the n pieces of foil thickness-uniformizing sub-anodes at current densities Dm ($A/dm^2$), preferably by a feedback system, so that the foil thicknesses Tm ($g/m^2$)(where $m=1\sim n$) are made equal to the target foil thickness T($g/m^2$), whereby the foil thickness is made uniform widthwise.

In its second aspect, the invention also provides a method of producing an electrolytic copper foil by passing an electrolyte between a rotating cathode drum and at least one sheet of anode located opposite to the cathode drum, thus electrolytically depositing copper on the cathode drum surface, and then peeling off the resulting copper foil from the drum, characterized by:

(a) constructing said anode so as to have a structure such that the end portion thereof on the copper foil-recovering side is divided widthwise into n pieces of foil thickness-uniformizing sub-anodes, and the remainder of the anode serves as a main anode;

(b) supplying electricity to the main anode and the foil thickness-uniformizing sub-anodes at a given current density D ($A/dm^2$) set to attain a target foil thickness T ($g/m^2$); and (c) dividing a pattern of thickness deviations of a copper foil produced per revolution of the cathode drum into m sections (where $m=1\sim n$) widthwise and k sections lengthwise, thus forming $m \times k$ sections, measuring the foil thicknesses $Tm-k$ ($g/m^2$) (where $m=1\sim n$) of the $m \times k$ sections corresponding to the angle of rotation from a reference point of the cathode drum using an encoder which determines the angle of rotation of the cathode drum, and individually increasing or decreasing under control the quantities of electricity supplied to the n pieces of foil thickness-uniformizing sub-anodes at current densities $Dm-k$ ($A/dm^2$) (where $m=1\sim n$ ), preferably by a feedback system, correspondingly to the angle of rotation from the reference point of the cathode drum so that the foil thicknesses $Tm-k$ ($g/m^2$) of the divided sections are as become equal to the target foil thickness T ($g/m^2$), whereby the foil thickness is made uniform.

In an embodiment of the invention, the main anode forms from 90 to 98% of the target foil thickness T ($g/m^2$) and the foil thickness-uniformizing sub-anodes from forms 2 to 10% of the target foil thickness. According to this invention, the variations in thickness of the copper foil produced are controlled to a strikingly low level of 1% or less, even on the order of no more than 0.5%, on the basis of the target thickness. It will be appreciated that the uniformity of thickness thus realized is quite remarkable when it is compared with the above-mentioned IPC standard of "within ±10%". This result was beyond one's expectations.

REFERENCES TO THE RELATED TECHNIQUES

U.S. Pat. No. 3,799,847 (Japanese Patent Application Kokai No. 49-27404) discloses a method and apparatus of producing a metal band having a roughened surface with higher adhesive strength than before by providing a plurality of separate anode plates around a cathode drum, said anode plates having increased current densities to form a thoroughly developed roughened surface. The present invention is entirely different from that of this reference in that the object of this reference is to provide a sufficiently developed roughened surface of a metal band to exhibit greater adhesion to a substrate than before and that the anode sheets are spaced from each other longitudinally around the cathode drum so as to change the current densities.

U.S. Pat. No. 4,053,370 (Japanese Patent Application Kokai Nos. 52-36761 and -36762) provides a process wherein a circuit pattern comprising a high density major layer and a roughened surface layer is formed by a practically single step using a first anode and a second anode, with the roughened surface layer being intended to strengthen the adhesion of the circuit pattern to an insulating base. The first anode is spaced from a cathodic metal strip by a distance in the range of 1 to 10 mm, while the second anode is spaced from the metal strip by a distance in the range of 5 to 25 mm. The first and second anodes are disposed apart from each other around the cathode roll, not widthwise.

U.S. Pat. No. 4,490,218 discloses a process for producing a surface treated metal foil which comprises providing a first current density in a first zone for plating a cathodic surface with a relatively smooth metal deposit and super-imposing a second current density having a magnitude greater than the limiting current density over said first current density in a second zone. The primary anodes and a treatment anode are also herein spaced from each other around a drum as in the aforementioned references.

Japanese Patent Application Kokoku Nos. 49-18902 and 50-2378 also disclose the provision of annular electrolytic cell sections each having an anode around a cathode drum for individually controlling the deposition conditions in the production of a metal foil. The anode in individual cells are not divided widthwise.

Japanese Patent Application Kokai Nos. 63-259098 relates to a method of controlling the plating current in continuous electroplating of a steel strip. The object is to prevent superfluous plating around and beyond the strip edges and overplating at edge portion by the concentration of the current toward to edge portions. Although an anode is divided widthwise, it is for controlling the edge currents of various strips having different widths. The current density of a center portion is kept constant. This reference is entirely different in object from the present invention wherein the thickness of a copper foil is uniformized.

It is apparent that none of the aforementioned references disclose the object and characteristic points of this invention.

DESCRIPTION OF THE EMBODIMENTS

Figure 3:
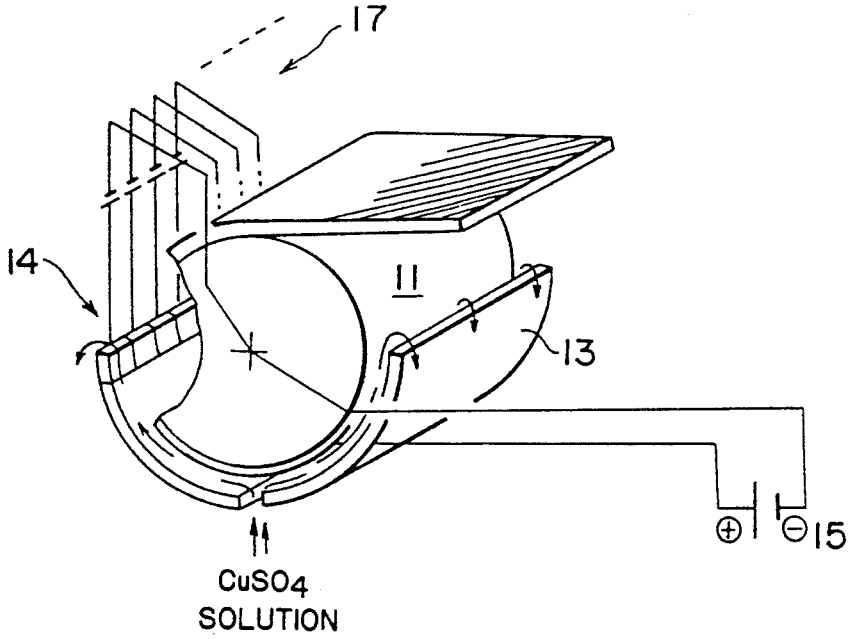
FIGS. 3 and 4 are perspective and front views, respectively, of the major parts of an apparatus suited for practicing one embodiment of the method of the invention for producing an electrolytic copper foil.
Figure 4:
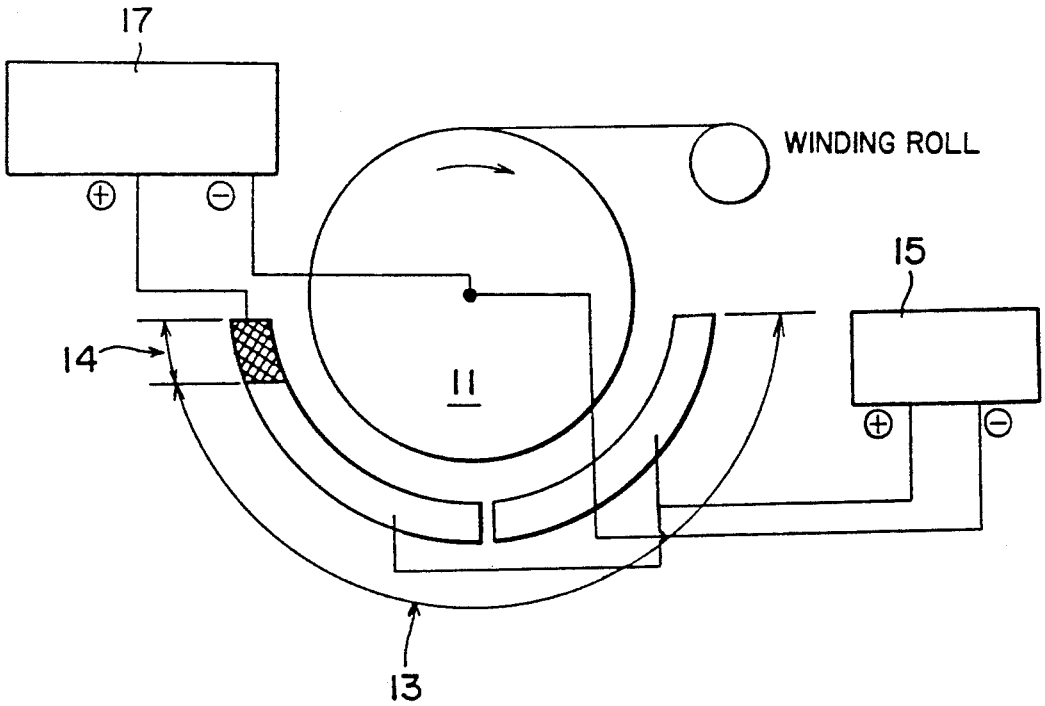

FIGS. 3 and 4 show the major parts of an apparatus suited for practicing the method of the invention for producing an electrolytic copper foil. As explained earlier, the electrolytic copper foil is produced by passing a stream of electrolyte through a space between a rotating cathode drum and an anode facing the drum, thus allowing gradual electrodeposition of copper on the cathode drum surface, peeling off the resulting copper foil which has attained a predetermined thickness from the cathode drum, and then winding up the peeled foil on a winding roll.

In accordance with the invention, the end portion of the copper foil-recovering side of the anode is divided widthwise into n pieces of sub-anodes 14 for uniformizing copper foil thickness. The remainder of the anode, i.e., excepting the foil thickness-uniformizing sub-anodes, is in the form of two anode sheets intended to serve as main anodes 13. The main anodes 13 constitute a region for producing the basic thickness of the copper foil, and the sub-anodes is a region for uniformizing the copper foil thickness. A main rectifier 15 is connected between the cathode drum 11 and the main anodes 13 to supply a controlled quantity of electricity to maintain a constant current density across the entire width of the main anodes. In order that the n pieces of foil thickness-uniformizing sub-anodes 14 can individually control the current densities between themselves and the cathode drum 11, the corresponding number, or n pieces, of the thickness-uniformizing rectifiers 17 are connected between the individual sub-anodes 14 and the cathode drum 11.

The larger the number of pieces, n, of the sub-anodes the more precisely the control can be exercised. Greater difficulties will be involved, however, in fabrication and maintenance. Generally, depending on the width of the copper foil to be made and on the conditions of the foil-production equipment used, one end portion of the anode is divided into from 10 to 40, typically around 30 pieces.

Between adjacent sub-anodes is interposed an insulating seal. Too between the sub-anodes and the main anode an insulating seal is interposed. Useful insulating materials for this purpose include sheets of PVC and cold cure rubber (e.g., one marketed under the trade designation "RTV"). Insulation is provided instead by bonding adjacent sub-anodes with an insulating adhesive or by integrally joining the sub-anodes with an insulating film therebetween.

Now the operation for the manufacture of electrolytic copper foil will be explained. In an electrolytic cell (not shown) which contains an electrolyte such as a sulfuric acid solution of copper sulfate, a cathode drum 11 which is a rotatable cylinder, e.g., of stainless steel or titanium, is held in place by support means, as partly submerged in the electrolyte, and made rotatable clockwise in the embodiment shown. There are provided two arcuate insoluble main anodes 13 and n pieces of foil thickness-uniformizing sub-anodes 14 (altogether called "the anode"), surrounding approximately the submerged lower hal f part of the cathode drum 11 and spaced a predetermined distance from the drum surface.

The main anodes 13 preferably consists of two anode sheets each disposed along about a lower quarter of the cathode drum as shown. According to the necessity, it may be replaced by a single anode sheet or by three, four, or more anode sheets.

The space between the cathode drum 11 and the anode 13, 14 is kept constant, usually in the range from 2 to 100 mm. The narrower the space the less the electricity consumption but more difficult will be the control of the foil thickness and quality.

This space between the cathode drum and the anode forms a flow passage for the electrolyte. The electrolyte is supplied at 6 o'clock position between the two anode sheets 13 by way of a proper pump (not shown) in the cell. It passes as divided streams in opposite directions along the space and overflows the both upper edges of the anode sheets for circulation.

The main rectifier 15 maintains a given current between the cathode drum 11 and the main anodes 13.

As the cathode drum 11 rotates, electrodeposition of copper from the electrolyte, which starts approximately at 3 o'clock position, progresses until the deposit attains a desired thickness at about 9 o'clock position where the electrodeposition comes to an end. The foil of the desired thickness is peeled off by suitable peeler means at about 12 o'clock position and wound up. In actual operation, however, the copper foil thus peeled off is not uniform in thickness.

Specifically, the anode, especially of the lead type, is locally worn with use. This results in variation in space between the cathode drum and the anode. In addition, the cathode drum can be responsible for some variation in foil thickness, and the electrolyte stream can undergo a certain deflection or irregularity in flow. Altogether, they tend to cause localized variation in thickness in the direction of the width of the resulting foil. Further, the eccentricity of between the anode and the cathode drum can be a primary cause of thickness variations lengthwise of nearly the same pattern on revolutions of the cathode drum 11.

Figure 1:
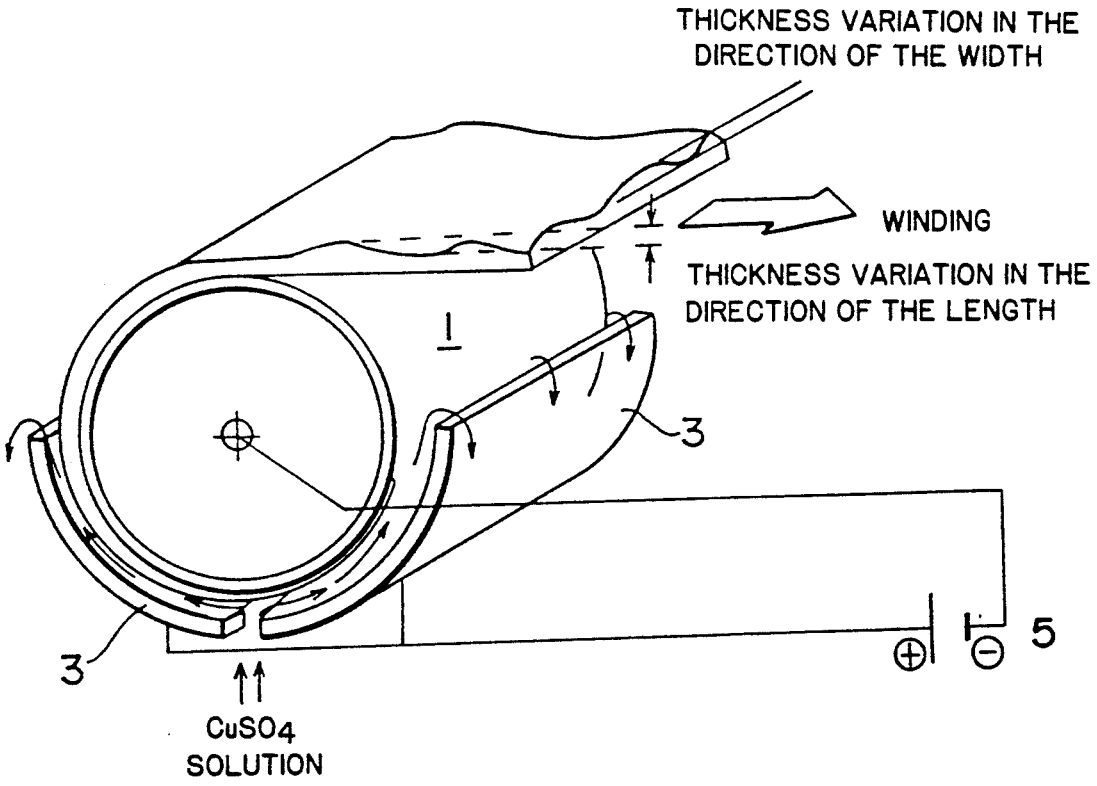
FIG. 1 (PRIOR ART)
FIG. 1 is a schematic perspective view of the major parts of a conventional apparatus for producing an electrolytic copper foil.
Figure 2:
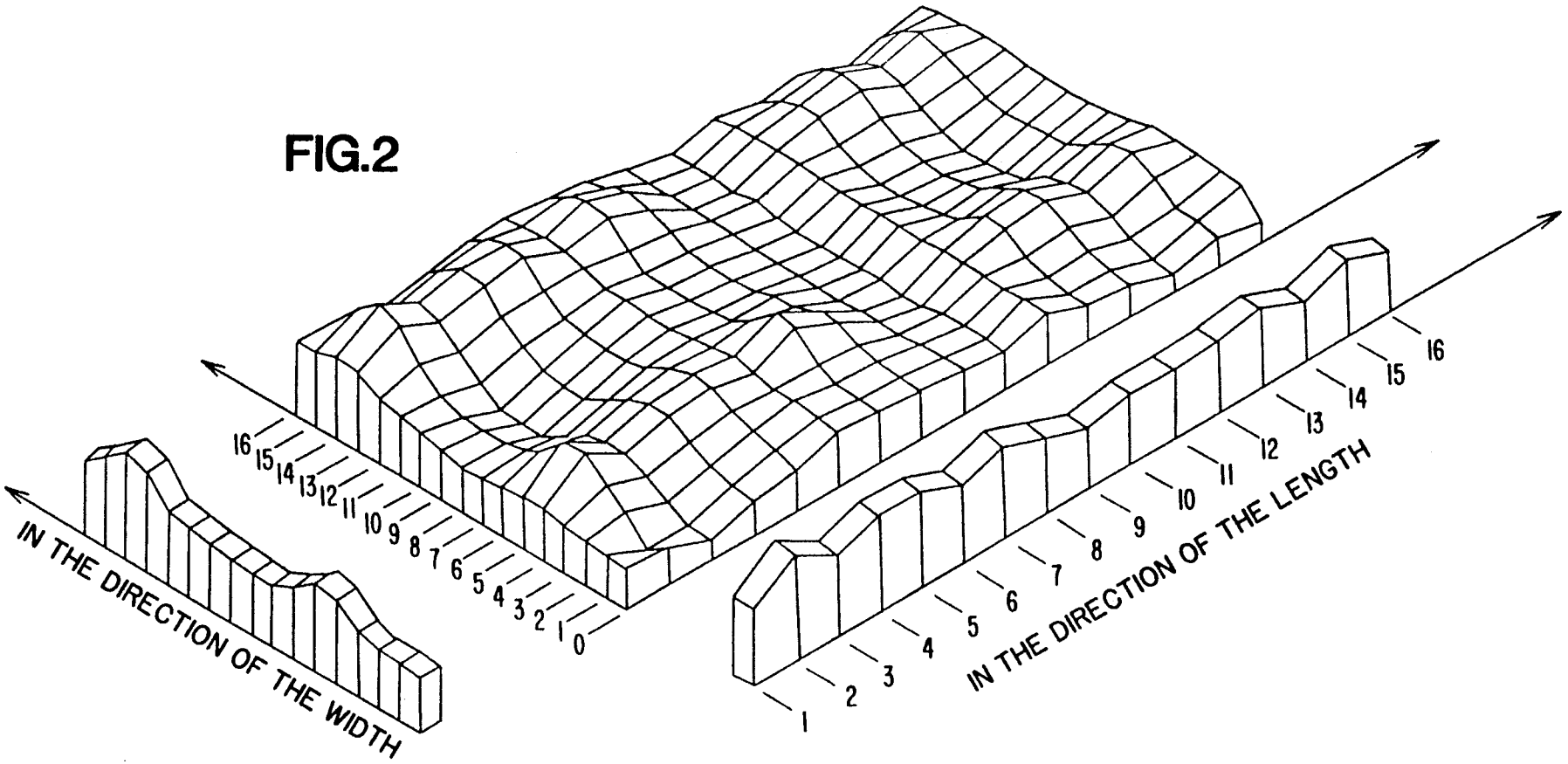
FIG. 2 is a diagrammatic illustration of variations in thickness of a half-width section of a copper foil in the directions of the width and length.

FIG. 2 schematically shows an illustrative variation in thickness widthwise and lengthwise of a half-width section of a copper foil. In the direction of the width, the remaining half-width section not shown has a generally similar variation in thickness. Usually, the variation in the direction of the width is more pronounced than that in the direction of the length. In the manufacture of electrolytic copper foil it is generally possible in many cases to make the entire copper foil even in thickness by correcting the variation widthwise. However, the mere control in the direction of the width has a limitation in correcting the overall variation, and when this is a problem the removal of variation in the direction of the length must also be taken into account.

By way of example, the case where variation in the direction of the width has resulted from the copper foil manufacture under the above conditions will now be considered. With the embodiment being described, the thickness in the direction of the width of the untreated foil is determined after the peeling and, when a thickness variation beyond a permissible limit has been detected, the electrical currents being supplied to the specific sub-anodes 14 corresponding to the specific portions in the direction of the width are individually controlled toward the removal of the variation. To permit this individual control of the sub-anodes 14, thickness-uniformizing sub-rectifiers 17 are connected between the individual sub-anodes 14 and the cathode drum 11.

The thickness values at different points in the direction of the width of the copper foil can be simply determined by suitable sampling, in terms of the weight per unit area. Alternatively, a thickness measuring instrument, such as of the static capacity detection type or X-ray type, may be installed in the winding route to monitor the thickness, cooperatively with the thickness-uniformizing sub-rectifiers 17 via feedback means.

The operation will now be described in detail. Electricities supplied to the main anodes and the foil thickness-uniformizing sub-anodes at a preset current density D ($A/dm^2$) to attain a target foil thickness T ($g/m^2$). Variations in the thickness in the direction of the width of the copper foil thus produced are measured as the foil thicknesses Tm ($g/m^2$) (where $m=1\sim n$) corresponding to the n pieces of foil thickness-uniformizing sub-anodes 14. The quantities of electricity being supplied to the n pieces of foil thickness-uniformizing sub-anodes are set to current densities Dm ($A/dm^2$)(where $m=1\sim n$), so that the individual foil thicknesses Tm ($g/m^2$)(where $m=1\sim n$) are equalized to be the target foil thickness T ($g/m^2$). The quantities of electricity are preferably controlled through a feedback system for increase or decrease to achieve the uniformity of foil thickness widthwise.

The main anodes are supplied with a given constant quantity of electricity at a current density D ($A/dm^2$). On the other hand, the n pieces of foil thickness-uniformizing sub-anodes are supplied with electricity at current densities Dm ($A/dm^2$) (where $m=1\sim n$ ), with individual control for increase or decrease, so that the foil thicknesses in the width direction Tm ($g/m^2$) (where $m=1\sim n$) are made equal to the target foil thickness T ($g/m^2$).

Desirably, the main anodes produce a foil with a thickness equivalent to from 90 to 98% of the target foil thickness T ($g/m^2$), and the foil thickness-uniformizing sub-anodes make up the remaining 2 to 10% of the target thickness.

In this way, the variation in the thickness widthwise of the resulting copper foil can be controlled within $\pm 1\%$ of the target level.

When the variation in the foil thickness in the direction of the length too is a problem, pattern control is conducted.

In that event, the thicknesses in both length and width directions of the untreated foil are determined after the peeling and, when any thickness deviation from the target level has exceeded a permissible limit, the quantities of electric supply to the specific foil thickness-uniformizing sub-anodes are controlled, on the basis of the combination of thickness patterns in the directions of the length and width, so as to correct the excessive variation.

To be more detail, the thickness patterns per revolution of the cathode drum are determined beforehand, and the quantities of electricity being supplied to the sub-anodes concerned are controlled.

For the purposes of the invention the expression "the thickness pattern per revolution of the cathode drum" is used to mean deviations (e.g., variations) in thickness from the target thickness of the copper foil formed upon one complete turn of the cathode drum measured, e.g., at 900 points chosen by dividing the copper foil area by 30 lengthwise and by 30 widthwise, i.e., $30\times 30=900$. It represents the combination of a thickness pattern in the direction of the length and a thickness pattern in the direction of the width.

The case in which the thickness of a copper foil is measured beforehand at a total of 900 points as chosen above will now be explained.

Any deviation from the target thickness (e.g., variation in thickness) at the 900 points, as noted above, represent those caused by irregularities in the uniformity of the cathode-anode spacing, the flow rate of electrolyte fed, the quantity of electricity supplied, etc. They indirectly represent the relations between a given portion of the cathode drum and the anode during one complete turn of the particular portion round the drum along a given track thereon (the relations given in terms of changes in the spacing, electrolyte flow rate, quantity of electricity supplied, etc.) and therefore represent the variation in thickness.

It follows that, in order to obtain a copper foil having a predetermined thickness, it is necessary to decide on and control the quantities of electricity to be supplied to the individual sub-anodes in conformity with the thickness deviation pattern from the target thickness of the 900 points. The thickness of the copper foil being produced is monitored and, when a change beyond a permissible limit has taken place, the quantity of electricity being supplied to the corresponding portion of the deviation pattern is controlled. In this way a copper foil having a predetermined thickness in the both directions of the length and width can be obtained.

Figure 5:
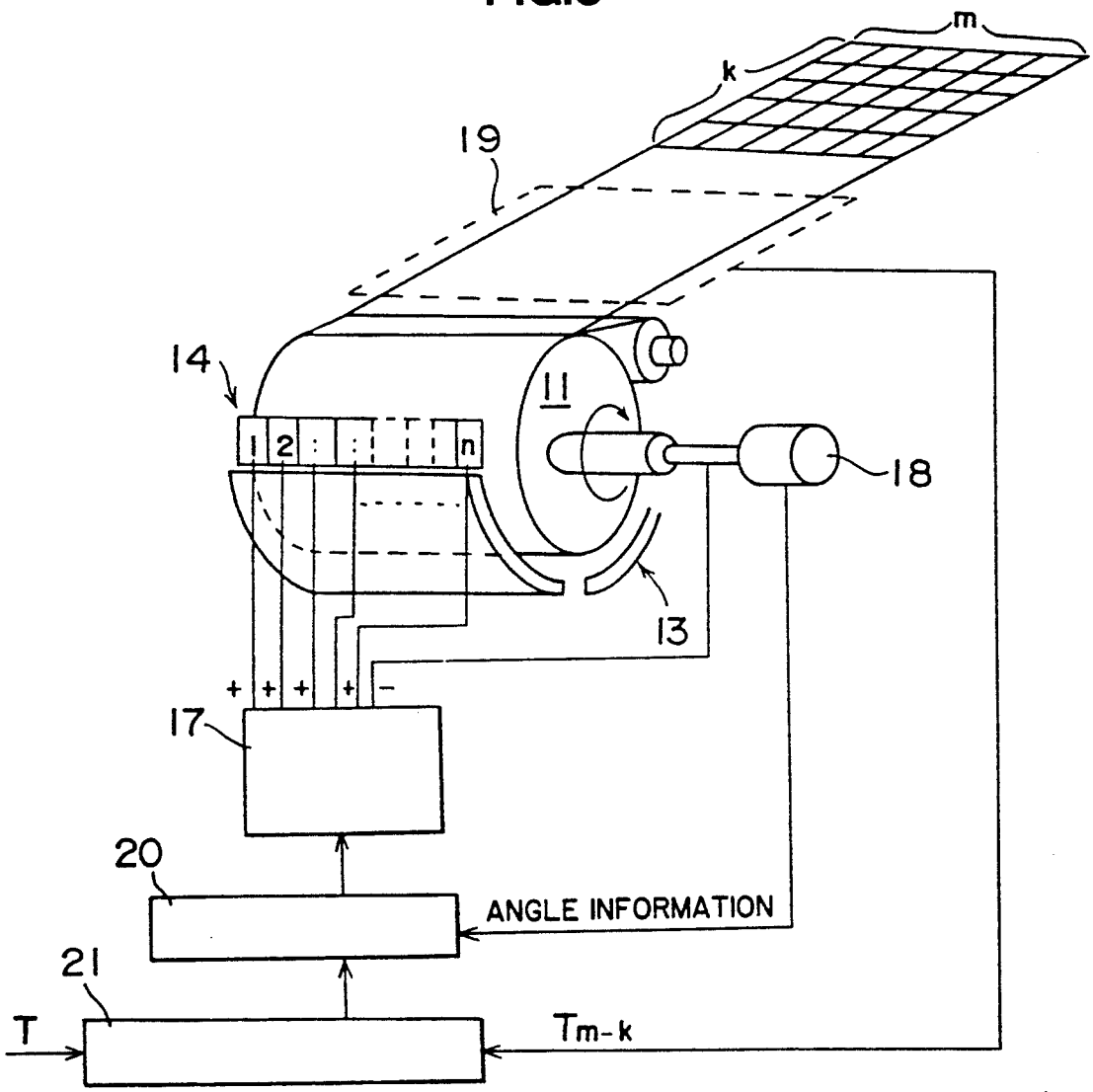
FIG. 5 is a schematic view of an apparatus for practicing another embodiment of the method of the invention for producing an electrolytic copper foil.

Referring to FIG. 5, there is shown a pattern of thickness deviations of a copper foil produced per revolution of the cathode drum 11, as divided into m sections (where $m=1\sim n$) widthwise and k sections lengthwise, thus forming $m \times k$ square sections. Using an encoder 18 which determines the angle of rotation of the cathode drum 11, the foil thicknesses $Tm-k$ ($g/m^2$) (where $m=1\sim n$) of the $m \times k$ sections corresponding to the angle of rotation from a reference point of the cathode drum are measured in a foil thickness measuring stage 19. The thickness informations obtained are passed to a calculator 21 for calculating the deviations of the measured $Tm-k$ ($g/m^2$) from the target foil thickness T ($g/m^2$) and providing foil thickness variation informations to rectifier controller 20. The angle informations from the encoder 18 are also sent to the rectifier controller 20. In order that the foil thicknesses $Tm-k$ ($g/m^2$) of the divided sections become equal to the target foil thickness T ($g/m^2$), the quantities of electricity supplied to the n pieces of foil thickness-uniformizing sub-anodes 14 are adjusted to current densities $Dm-k$ ($A/dm^2$)(where $m=1\sim n$) and controlled individually by the corresponding n units of sub-rectifiers 17 for increase or decrease, preferably by a feedback system, correspondingly to the angle of rotation from the reference point of the cathode drum.

Here again it is desirable that the main anodes produce a foil with a thickness equivalent to form 90 to 98% of the target foil thickness T ($g/m^2$), and the foil thickness-uniformizing sub-anodes make up the remaining 2 to 10% of the target thickness.

In this manner the variations in thickness of the copper foil produced can be controlled within ±1% of the target level.

With the embodiment being described, the thickness of the electrolytic copper foil being produced can be controlled by individually controlling the quantities of electricity supplied to the sub-anodes on the basis of a combination of the patterns of foil thicknesses in both directions of the length and width.

Although it appears that a single row of sub-anodes usually will do, a plurality or multiplicity of rows may be provided instead where the variation is beyond control with a single row or where more precise control is needed.

Examples of this invention are set forth below. It is to be noted that these examples are not intended to restrict this invention.

EXAMPLE 1 AND COMPARATIVE EXAMPLE

Figure 6:
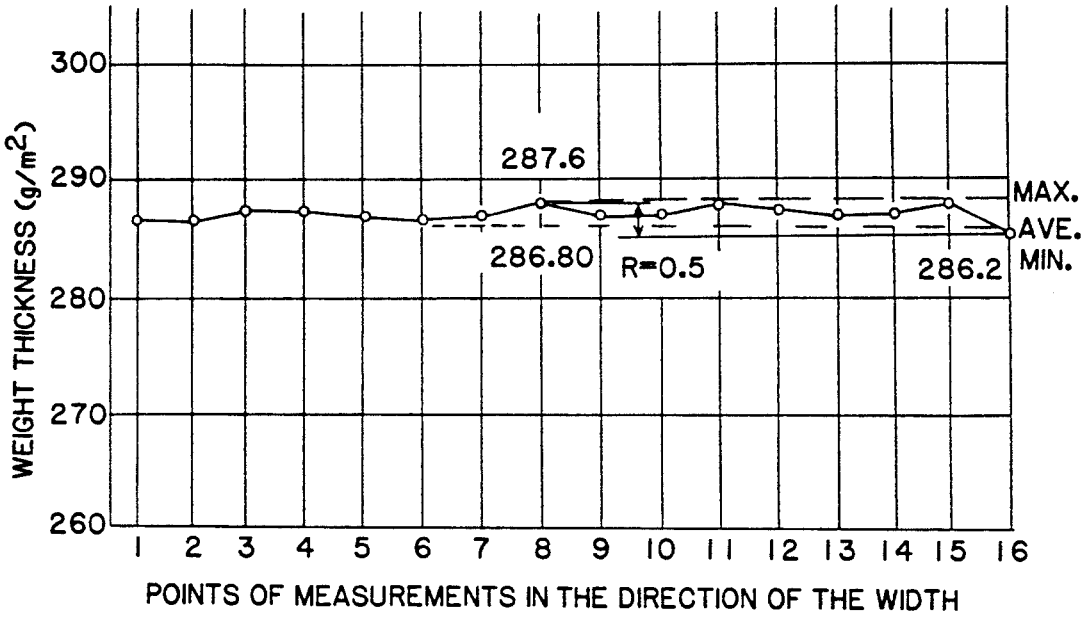
FIGS. 6 and 7 are graphs showing measured thickness distributions in the direction of the width of electrolytic copper foils produced in Example 1 and Comparative Example, respectively.
Figure 7:
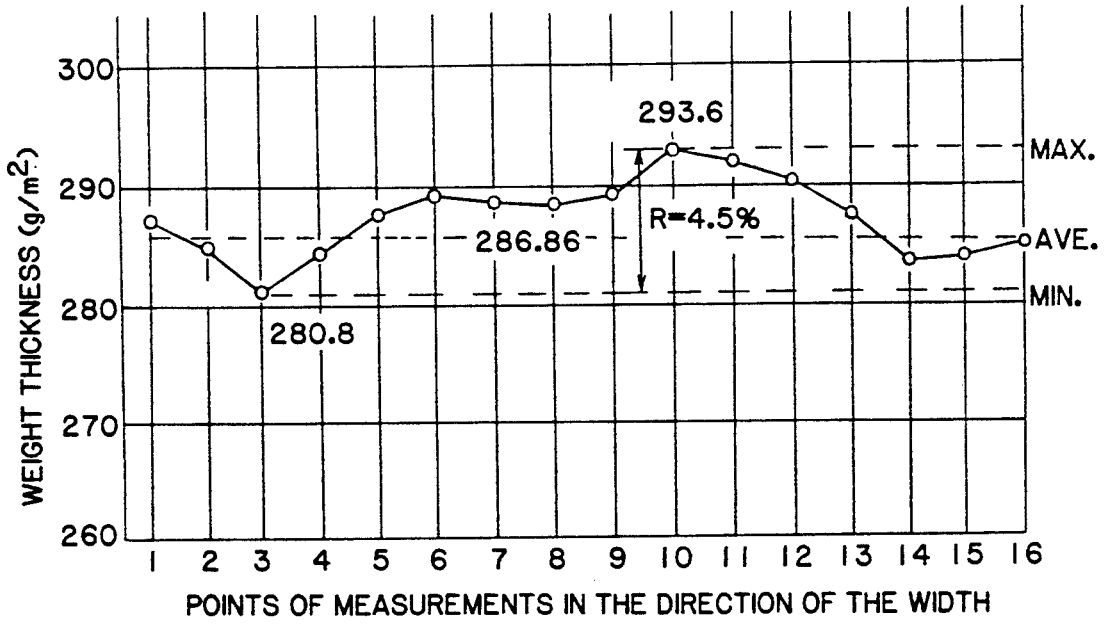

A copper foil 35 μm thick (nominal thickness, 1 ounce/$ft^2$) was made using a copper sulfate solution and a combination of a cathode drum 2.0 m in diameter and 1.3 m wide and two 1.3 m wide anode sheets arranged arcuately along substantially the lower half of the cathode drum as shown in the drawings. The anode structure according to the invention was as depicted in FIGS. 3 and 4 and comprised 30 sub-anodes. On the basis of the weight values per unit area of the peeled copper foil, the electric currents supplied to the individual sub-anodes were adjusted within the range of 0.1 to 10 $A/dm^2$. Thus, the method of the invention rendered it possible to reduce the variation in thickness widthwise, from the usual level of about 4.5% down to 0.5% or less as shown in FIGS. 6 and 7, respectively, where the thicknesses at points 1 to 16 in the half-width sections of the foils made according to this invention and conventionally were measured in terms of weight per unit area ($g/m^2$).

EXAMPLE 2

A 35 μm-thick copper foil was made using a copper sulfate solution and a combination of a cathode drum 2.0 m in diameter and 1.3 m wide and two 1.3 m wide anode sheets arranged arcuately along substantially the lower half of the cathode drum as shown. The anode structure according to the invention was as depicted in FIGS. 3 and 4 and comprised 30 sub-anodes.

On the basis of thickness patterns in the directions of the length and width per revolution of the cathode drum that had been determined beforehand (at 30 points widthwise $\times 30$ points lengthwise $=900$ points ), the electric currents supplied to the individual sub-anodes were calculated with a personal computer and adjusted within the range of 0.1 to 10 $A/dm^2$. Thus the method of the invention made it possible to reduce the variation in thickness widthwise, from the usual level of about 4.5% down to 0.5% or less. In the direction of the length, the variation was reduced from the usual range of about 2% down to 0.5% or less.

ADVANTAGE OF THE INVENTION

The thickness of copper foil is now successfully made uniform, for the first time in the art, by far the greater degree than heretofore, with thickness variations reduced strikingly from the usual level, to less than about a tenth of the usual level in the direction of the width and to less than about a fourth of the usual level in the direction of the length, by individually controlling, during the operation, the quantities of electricity being supplied into a plurality of foil thickness-uniformizing sub-anodes divided widthwise. The foil product obtained is promising as a copper foil required for future electronic devices or the like.

We claim:

1. A method of producing an electrolytic metallic foil comprising the steps of:

(a) providing electrolyte between a rotating cathode drum and at least one anode structure in the configuration of a sheet, the rotating cathode drum having an outer surface, the anode structure located opposite to the cathode drum outer surface and having a side facing the outer surface of the drum, the anode structure spaced from and along the drum so as to form a gap therebetween and having a width parallel to the rotational axis of the drum and a total length, the anode structure being defined by a main portion serving as a main anode and an end portion, the main portion defined by a first portion of the total length of the anode structure and the end portion defined by a second portion of the total length of the anode structure, the main portion being undivided widthwise, the end portion being divided widthwise into n foil thickness-uniformizing sub-anodes, the main portion and the sub-anodes being electrically insulated from each other;

(b) electrolytically depositing metal on the cathode drum outer surface by supplying electricity to the main anode at a current density D and supplying electricity to the foil thickness-uniformizing sub-anodes at current densities Dm, the current density D and densities Dm being set to attain a target foil thickness T;

(c) peeling off the resulting metallic deposition as a metallic foil from the cathode drum;

(d) measuring variations of thickness in the direction of the width of the resulting metallic foil as n thicknesses Tm corresponding to the n foil thickness-uniformizing sub-anodes, the foil width being the foil's dimension parallel to the rotational axis of the drum; and (e) individually increasing or decreasing the quantities of electricity being supplied to the n foil thickness-uniformizing sub-anodes at the current densities Dm in response to the measured thicknesses Tm, so that the n foil thicknesses Tm are made to approach the target foil thickness T.

2. The method of claim 1 wherein the foil thickness formed by steps (a) through (e) is proportional to the total length of the anode structure and electrical potential supplied thereto, the length of the main anode and electrical potential supplied thereto being such that in step (b) the main anode forms essentially from 90 to 98% of the target foil thickness T and the length of the end portion and electrical potential supplied thereto being such that in step (b) its foil thickness-uniformizing sub-anodes form essentially from 2 to 10% of the target foil thickness.

3. The method of claim 2 wherein the variations in thickness of the metallic foil produced using the steps (a) through (e) are 1% or less of the target foil thickness T.

4. The method of claim 1 wherein the variations in thickness of the metallic foil produced using the steps (a) through (e) are 1% or less of the target foil thickness T.

5. The method of claim 1 wherein n=10 to 40.

6. The method of claim 1 wherein the metallic foil is copper foil.

7. An apparatus for forming a metallic foil from an electrolyte comprising:

(a) a rotating cathode drum having an outer surface;

(b) at least one anode structure in the configuration of a sheet located opposite to the cathode drum outer surface and having a side facing the outer surface of the drum, the anode structure spaced from and along the drum so as to form a gap therebetween and having a width parallel to the rotational axis of the drum and a total length, the anode structure including (i) a main portion serving as a main anode, the main portion defined by a first portion of the total length of the anode structure and being undivided widthwise; and (ii) an end portion defined by a second portion of the total length of the anode structure and divided widthwise into n foil thickness-uniformizing sub-anodes, the main portion and the sub-anodes being electrically insulated from each other;

(c) means for applying electrical potentials to the main anode and individual ones of the n foil thickness-uniformizing sub-anodes, the electrical potential applied to the main anode being independent of the electrical potentials applied to the sub-anodes, the electrical potentials being set to attain a target foil thickness T;

(d) means for passing an electrolyte between the rotating cathode drum and the anode structure, thereby electrolytically depositing metal on the cathode drum outer surface;

(e) means for peeling off the metal from the drum, thereby forming a resulting metallic foil;

(f) means for measuring variations of thickness in the direction of the width of the resulting metallic foil as n thicknesses Tm corresponding to the n foil thickness-uniformizing sub-anodes, the foil width being the foil's dimension parallel to the rotational axis of the drum; and (g) means for individually controlling the electrical potential applied to the individual n foil thickness-uniformizing sub-anodes in response to the measured thicknesses Tm, thereby causing the n foil thicknesses Tm to approach the target foil thickness T.

8. The apparatus in claim 7 wherein the foil thickness formed by the apparatus is proportional to the total length of the anode structure and electrical potential applied thereto, the length of the main anode and electrical potential applied thereto being such that it is adapted to form essentially from 90 to 98% of the target foil thickness T and the length of the end portion and electrical potential applied thereto being such that its foil thickness-uniformizing sub-anodes are adapted to form essentially from 2 to 10% of the target foil thickness.

9. The apparatus in claim 8 wherein elements (a) through (g) are adapted to produce variations in thickness of the metallic foil of 1% or less of the target foil thickness T.

10. The apparatus in claim 7 wherein n=10 to 40.

11. The apparatus in claim 7 wherein the said apparatus is adapted to produce copper foil.

12. The apparatus in claim 7 wherein elements (a) through (g) are adapted to produce variations in thickness of the metallic foil of 1% or less of the target foil thickness T.

13. A method of producing an electrolytic metallic foil comprising the steps of:

(a) providing electrolyte between a rotating cathode drum and at least one anode structure in the configuration of a sheet, the rotating cathode drum having an outer surface, the anode structure located opposite to the cathode drum outer surface and having a side facing the outer surface of the drum, the anode structure spaced from and along the drum so as to form a gap therebetween and having a width parallel to the rotational axis of the drum and a total length, the anode structure being defined by a main portion serving as a main anode and an end portion, the main portion defined by a first portion of the total length of the anode structure and the end portion defined by a second portion of the total length of the anode structure, the main portion being undivided widthwise, the end portion being divided widthwise into n foil thickness-uniformizing sub-anodes, the main portion and the sub-anodes being electrically insulated from each other;

(b) electrolytically depositing metal on the cathode drum outer surface by supplying electricity to the main anode at a current density D and supplying electricity to the foil thickness-uniformizing sub-anodes at current densities Dm−k, the current density D and densities Dm−k being set to attain a target foil thickness T;

(c) peeling off the resulting metallic deposition as a metallic foil from the cathode drum;

(d) dividing a pattern of thickness deviations of the metallic foil produced per revolution of the cathode drum into m sections widthwise where m=1−n and k sections lengthwise, thus forming m ×k sections, the widthwise sections corresponding to the foil's dimension parallel to the rotational axis of the drum;

(e) measuring foil thicknesses Tm−k of the m ×k sections corresponding to the angle of rotation from a reference point of the cathode drum; and (f) individually increasing or decreasing the quantities of electricity being supplied to the n foil thickness-uniformizing sub-anodes at the current densities Dm−k in response to the measured thicknesses Tm−k and the angle of rotation from the reference point of the cathode drum, so that the foil thicknesses Tm−k of the divided sections are made to approach the target foil thickness T.

14. The method of claim 13 wherein the foil thickness formed by steps (a) through (f) is proportional to the total length of the anode structure and electrical potential supplied thereto, the length of the main anode and electrical potential supplied thereto being such that in step (b) the main anode forms essentially from 90 to 98% of the target foil thickness T and the length of the end portion and electrical potential supplied thereto being such that in step (b) its foil thickness-uniformizing sub-anodes form essentially from 2 to 10% of the target foil thickness.

15. The method of claim 14 wherein the variations in thickness of the metallic foil produced using the steps (a) through (f) are 1% or less of the target foil thickness T.

16. The method of claim 13 wherein the variations in thickness of the metallic foil produced using the steps (a) through (f) are 1% or less of the target foil thickness T.

17. The method of claim 13 wherein n=10 to 40.

18. The method of claim 13 wherein the metallic foil is copper foil.

19. An apparatus for forming a metallic foil from an electrolyte comprising:

(a) a rotating cathode drum having an outer surface;

(b) at least one anode structure in the configuration of a sheet located opposite to the cathode drum outer surface and having a side facing the outer surface of the drum, the anode structure spaced from and along the drum so as to form a gap therebetween and having a width parallel to the rotational axis of the drum and a total length, the anode structure including (i) a main portion serving as a main anode, the main portion defined by a first portion of the total length of the anode structure and being undivided widthwise; and (ii) an end portion defined by a second portion of the total length of the anode structure and divided widthwise into n foil thickness-uniformizing sub-anodes, the main portion and the sub-anodes being electrically insulated from each other;

(c) means for applying electrical potentials to the main anode and individual ones of the n foil thickness-uniformizing sub-anodes, the electrical potential applied to the main anode being independent of the electrical potentials applied to the sub-anodes, the electrical potentials being set to attain a target foil thickness T;

(d) means for passing an electrolyte between the rotating cathode drum and the anode structure, thereby electrolytically depositing metal on the cathode drum outer surface;

(e) means for peeling off the metal from the drum, thereby forming a resulting metallic foil;

(f) means for dividing a pattern of thickness deviations of the metallic foil produced per revolution of the cathode drum into m sections widthwise where m=1−n and k sections lengthwise, thus forming m ×k sections, the widthwise sections corresponding to the foil's dimension parallel to the rotational axis of the drum;

(g) means for measuring resulting metallic foil thicknesses Tm−k of the m ×k sections corresponding to the angle of rotation from a reference point of the cathode drum;

(h) means for measuring the angle of rotation from the reference point of the cathode drum; and (i) means for individually controlling the electrical potential applied to the individual n foil thickness-uniformizing sub-anodes in response to the measured thicknesses Tm−k, thereby causing the foil thicknesses Tm−k of the divided sections to approach the target foil thickness T.

20. The apparatus in claim 19 wherein the foil thickness formed by the apparatus is proportional to the total length of the anode structure and electrical potential applied thereto, the length of the main anode and electrical potential applied thereto being such that it is adapted to form essentially from 90 to 98% of the target foil thickness T and the length of the end portion and electrical potential applied thereto being such that its foil thickness-uniformizing sub-anodes are adapted to form essentially from 2 to 10% of the target foil thickness.

21. The apparatus in claim 20 wherein elements (a) through (i) are adapted to produce variations in thickness of the metallic foil of 1% or less of the target foil thickness T.

22. The apparatus in claim 19 wherein n=10 to 40.

23. The apparatus in claim 19 wherein said apparatus is adapted to produce copper foil.

24. The apparatus in claim 19 wherein the means for measuring the angle of rotation comprises an encoder.

25. The apparatus in claim 19 wherein elements (a) through (i) are adapted to produce variations in thickness of the metallic foil of 1% or less of the target foil thickness T.

* * * * *